US007065794B2

(12) United States Patent
Anderson

(10) Patent No.: US 7,065,794 B2
(45) Date of Patent: Jun. 27, 2006

(54) SECURE NECKTIE

(76) Inventor: Richard Anderson, 135 Jewett Ave., Bridgeport, CT (US) 06606

( * ) Notice: Subject to any disclaimer, the term of this patent is extended or adjusted under 35 U.S.C. 154(b) by 84 days.

(21) Appl. No.: 10/797,819

(22) Filed: Mar. 10, 2004

(65) Prior Publication Data

US 2004/0181846 A1 Sep. 23, 2004

Related U.S. Application Data

(60) Provisional application No. 60/455,920, filed on Mar. 19, 2003.

(51) Int. Cl.
*A41D 25/00* (2006.01)

(52) U.S. Cl. ..... 2/144; 2/145; 223/81; 223/82

(58) Field of Classification Search ..... 2/144, 2/145, 149; 223/81, 82; 24/13, 49.1, 51, 24/54, 55, 58, 65, 66.1, 66.2
See application file for complete search history.

(56) References Cited

U.S. PATENT DOCUMENTS 2,736,033 A * 2/1956 Brunetti et al. ..... 2/145
2,743,452 A * 5/1956 Waterbury ..... 2/145
2,746,055 A * 5/1956 Gleason ..... 2/145
2,749,553 A * 6/1956 Miller ..... 2/145
2,813,273 A * 11/1957 Schreter ..... 2/145
4,827,576 A * 5/1989 Prince, Jr. ..... 24/66.1
4,920,579 A * 5/1990 Swain ..... 2/145
4,972,523 A * 11/1990 Begg ..... 2/145
5,095,546 A * 3/1992 Jones ..... 2/145
5,216,785 A 6/1993 Graef
5,235,730 A 8/1993 Townsend
5,245,708 A * 9/1993 Campelia et al. ..... 2/145
5,315,713 A 5/1994 Pileggi
5,353,438 A 10/1994 Voiles
5,571,218 A 11/1996 Caniglia
5,715,538 A * 2/1998 Soll ..... 2/145
6,131,200 A * 10/2000 McNamara ..... 2/144
6,182,292 B1 * 2/2001 Knoll ..... 2/115
6,205,587 B1 * 3/2001 Shiffler ..... 2/146
6,209,136 B1 4/2001 Ophardt
6,216,275 B1 4/2001 Lee

* cited by examiner

*Primary Examiner*—Gary L. Welch
(74) *Attorney, Agent, or Firm*—Grimes & Battersby, LLP

(57) ABSTRACT

A necktie that is removably attachable to a button-down shirt of the type having a row of buttons disposed down the front thereof so as to prevent said necktie from moving out of place, said necktie comprising a single elongated article of clothing having a wide end having front and rear surfaces and a narrow end having front and rear surfaces, wherein a row of buttonholes is provided on said rear surface of said wide end and a corresponding first attachment button is provided on said front surface of said narrow end to attach said wide end to said narrow end such that said first attachment means is not visible on said front surface of said wide end, and wherein second row of buttonholes is provided on said rear surface of said narrow end to attach said rear surface of said narrow end to said row of buttons.

7 Claims, 3 Drawing Sheets

SECURE NECKTIE

RELATED APPLICATIONS

This is a non-provisional application based on co-pending U.S. Provisional Patent Application Ser. No. 60/455,920, filed Mar. 19, 2003, in the name of Richard Anderson.

BACKGROUND OF THE INVENTION

1. Field of the Invention

The present invention relates generally to neckties and, more particularly, to a modification to a standard necktie which allows the tie to be secured to a button-down shirt so as to keep the tie in place.

2. Description of the Prior Art

The traditional necktie is secured about the wearer's neck by means of a knot, and the two opposite ends or "tails" of the tie are allowed to drape down the front of the wearer's shirt from said knot. A major disadvantage of such configuration is that the two tails are free to move and separate, thereby ruining the finished look provided by the necktie. This problem is particularly evident on windy days or when the wearer is moving quickly, since the tie tends to flap around and potentially get damaged. While the narrower tail can often be inserted within a loop on the back of the wider tail, there is nothing preventing the two attached tails from moving.

There have been various attempts in the prior art to utilize a separate object or device designed to attach the tie to the shirt, such as a tie clip or tie pin. For example, U.S. Pat. No. 5,315,713, which issued to Pileggi on May 31, 1994 for an "Apparatus for restraining a variety of neckties" discloses attachment means on the back of a conventional necktie to secure the tie's normally concealed tail in two positions, and a horizontal member, having buttonholes therein, slidably mounted on the tail between the attachment means which may then be secured to a shirt button to hold the tie in place during normal wear. Another example is provided in U.S. Pat. No. 5,216,785, which issued to Graef on Jun. 8, 1993 for a "Tie fastener," which discloses a tie fastener having three strips of flexible material joined together at one end, wherein an inner strip is buttoned to a shirt, an outer strip is fed through the loop-label of the tie, and an intermediate strip is interposed between the inner and outer strips and serves to cover a shirt button and prevent the loop-label of the tie from catching on the button.

Other examples of separate devices are shown in U.S. Pat. No. 5,353,438, which issued to Voiles on Oct. 11, 1994 for a "Necktie restraint" discloses a device including a longitudinal strip of flexible material with a sewn longitudinal button hole on one end and a circular hole on the other and U.S. Pat. No. 5,235,730, which issued to Townsend on Aug. 17, 1993 for a "Concealed necktie holding device" discloses a device constructed in a manner such that is attached to the shirt via a button hole engagement cross-bar and attached to the necktie via a clamp, between which is a rectangular shaped holding device through which the narrow back panel of the necktie is inserted.

There have been numerous attempts to provide attachment means directly to the tie. For example, U.S. Pat. No. 6,216,275, which issued to Lee on Apr. 17, 2001 for a "Necktie with fixing device" discloses a fixing device including an elastic member secured to center of an anchoring member, with a small magnet secured to the end of the elastic member for engaging a zipper, belt buckle or other metallic fastening element of a clothing article. Similarly, U.S. Pat. No. 6,209,136, which issued to Ophardt on Apr. 3, 2001 for a "Multipurpose, one piece, variable necktie" discloses a one piece necktie having at least one foldable portion of the front apron constructed from at least two freely foldable flaps.

An alternative to providing a necktie that may be secured to an article of clothing is a shirt that retains or otherwise engages the necktie. For example, U.S. Pat. No. 6,182,292, which issued to Knoll on Feb. 6, 2001 for a "Shirt with necktie retainer" discloses a shirt with an incorporated necktie retainer for anchoring the two hanging termini of a necktie, so the ends don't encumber the wearer, wherein the vertically directed retainer has a place for two button holes that slip onto the shirt buttons after passing through the longitudinal name tag on the back of the wider hanging portion of a necktie. Another such device is shown in U.S. Pat. No. 5,571,218, which issued to Caniglia on Nov. 5, 1996 for a "Necktie restraining shirt" discloses a shirt provided with a small opening into which the rear tail portion of a necktie can be inserted, or a loop of material through which the rear tail portion of the necktie can be positioned with the front portion of the necktie then overlying the tail portion so as to conceal it, or both an opening to receive the rear tail portion of the necktie and a loop of material for receiving the front visible portion of the necktie.

Such devices, however, fail to offer the unique advantages of the novel secure necktie of the present invention, namely, to provide a necktie that may be attached securely to a button down shirt without the need for any additional securing means.

SUMMARY OF THE INVENTION

Against the foregoing background, it is a primary object of the present invention to provide a necktie that may be secured to a button down shirt to prevent the tie from moving out of place.

It is another object of the present invention to provide such a necktie that does not require the use of any additional attachment devices or special shirts.

It is still another object of the present invention to provide such a necktie that is inexpensive to manufacture.

It is but another object of the present invention to provide such a necktie that is easy to attach and remove.

It is another object of the present invention to provide such a necktie that appears in all respects to be a normal necktie when attached.

To the accomplishments of the foregoing objects and advantages, the present invention, in brief summary, comprises a necktie removably attachable to a button-down shirt of the type having a row of buttons disposed down the front thereof, said necktie being attached so as to prevent it from moving out of place. The necktie comprise a single elongated piece of material having a wide end a narrow end, wherein a row of buttonholes is provided on the rear surface of the wide end and a corresponding first attachment means is provided on the front surface of the narrow end to attach the wide end to the narrow end such that said first attachment means is not visible on the front surface of the wide end. A second row of buttonholes is provided on the rear surface of the narrow end to allow the attachment of the narrow end to one or more of the buttons on the shirt.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE PREFERRED EMBODIMENTS

Figure 1:
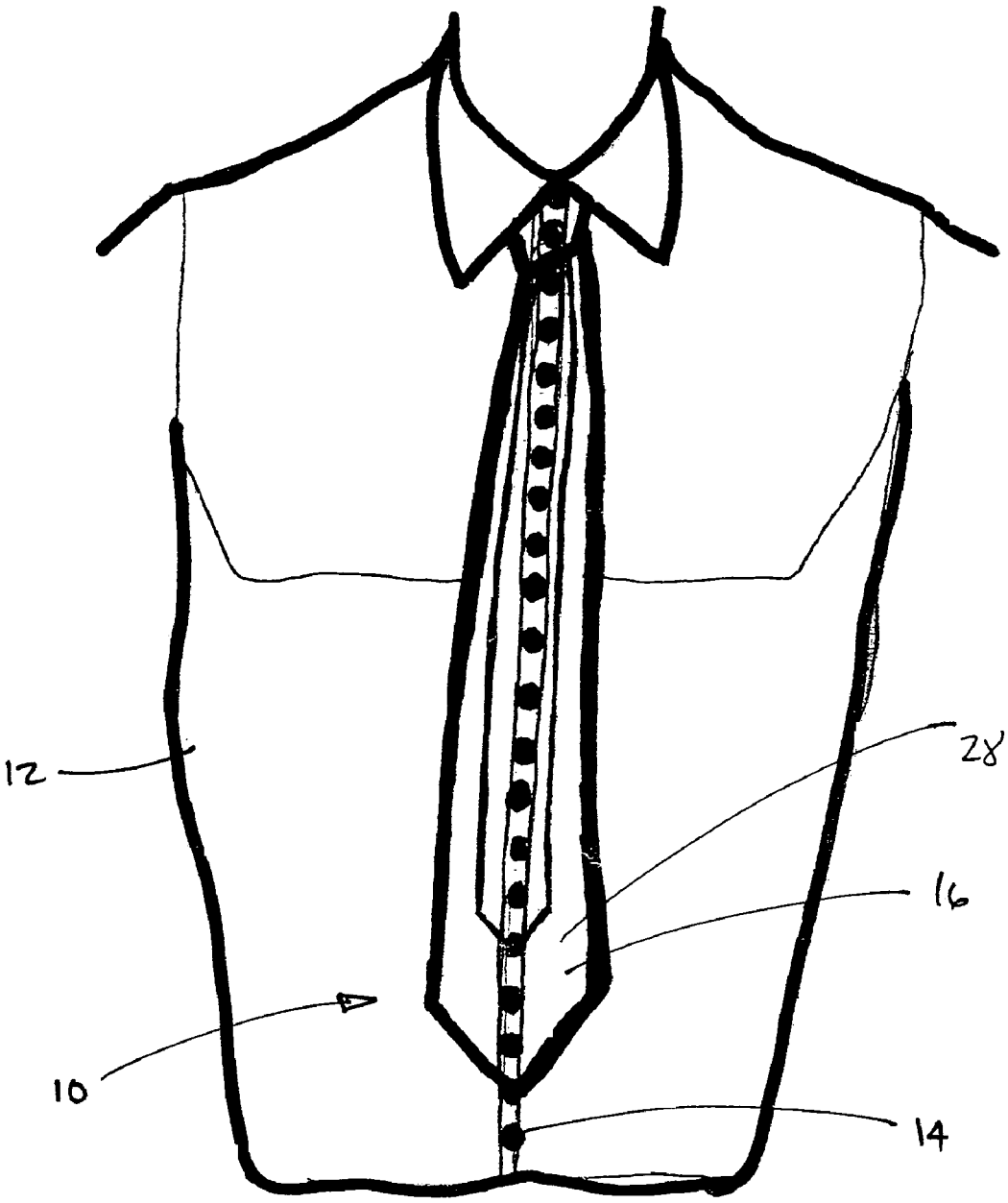
FIG. 1 is a front view of the novel necktie of the present invention showing the tie being attached to a button-down shirt.
Figure 2:
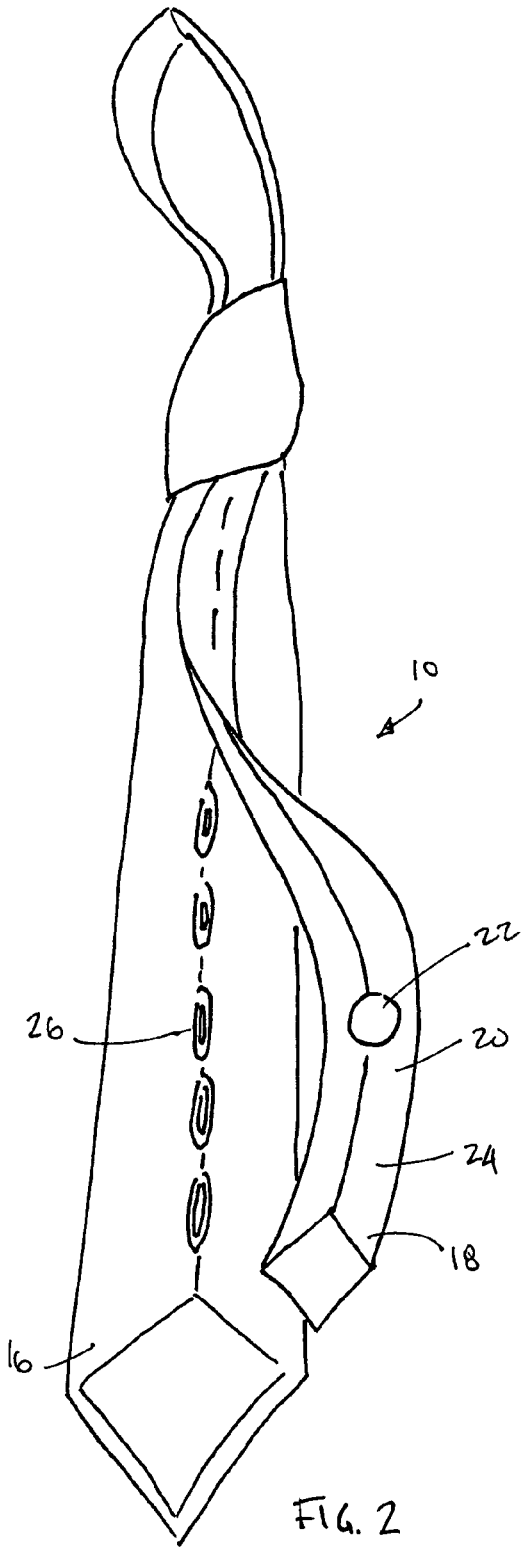
FIG. 2 is rear view of the novel necktie of FIG. 1 showing the means by which the two ends of the tie are secured to each other.
Figure 3:
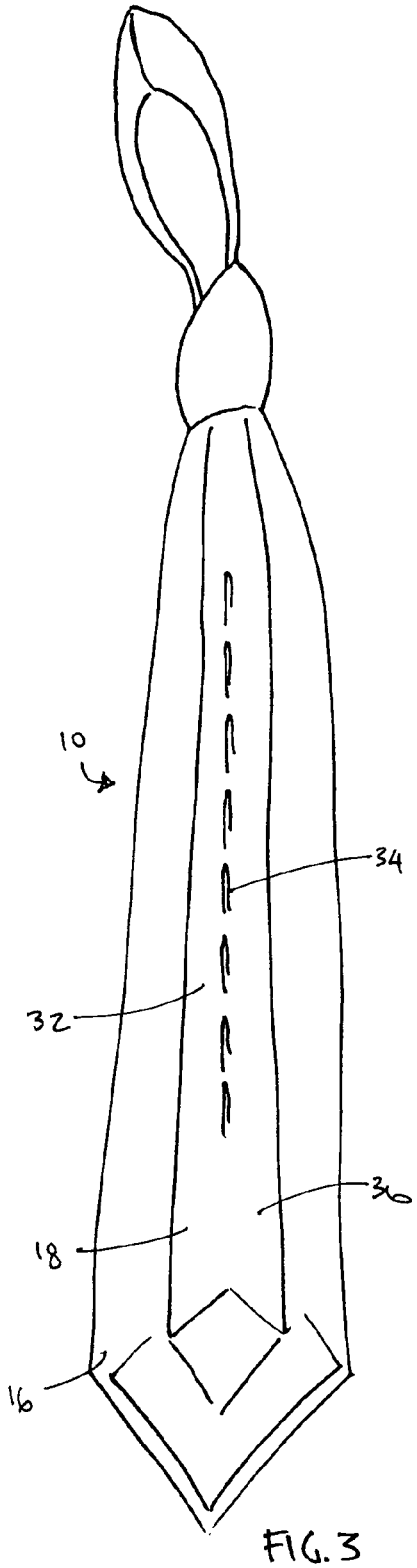
FIG. 3 is a rear view of the novel necktie of FIG. 1 showing the means by which the tie is attached to the button-down shirt.
Figure 4:
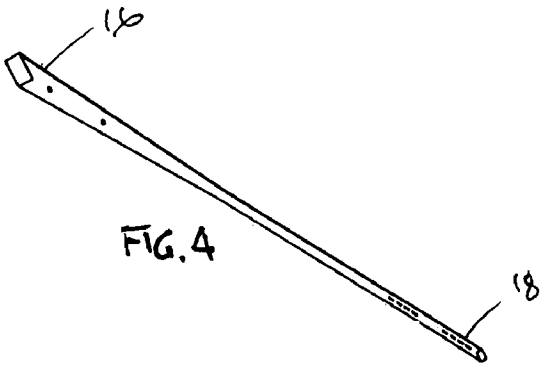
FIG. 4 is a perspective view of an alternative embodiment of the novel necktie of FIG. 1.
Figure 5:
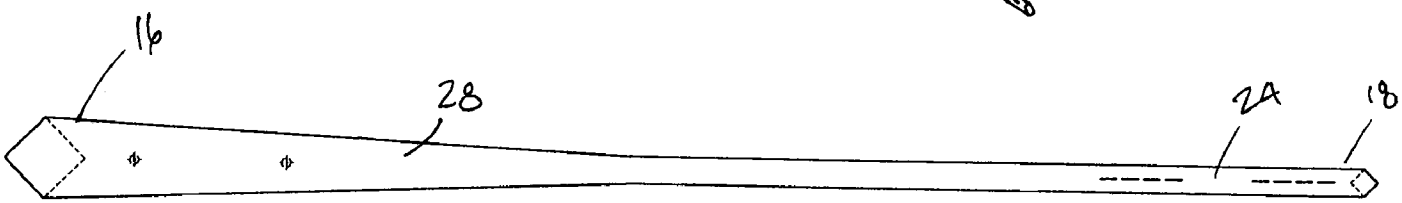
FIG. 5 is a top plan view of the alternative embodiment of FIG. 4.
Figure 6:
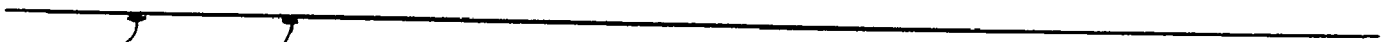
FIG. 6 is a side elevational view of the alternative embodiment of FIG. 4.
Figure 7:
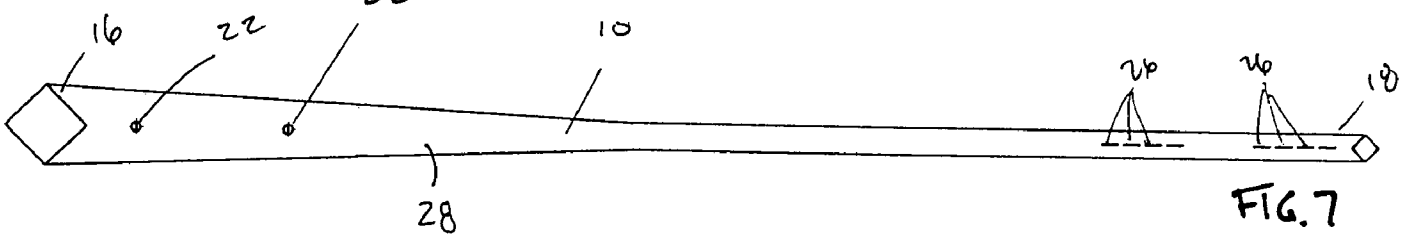
FIG. 7 is a rear elevational view of the alternative embodiment of FIG. 4.

Referring to the drawings and, in particular, to FIG. 1 thereof, the necktie of the present invention is provided and is referred to generally by reference numeral 10. The necktie 10 is designed to be worn with and affixed to a button-down shirt 12 of the type having a row of buttons 14 running down the center of the front of the shirt 12. The shape of the necktie 10 is identical to that of the traditional necktie in that it is a single elongated article of clothing having a wide end 16 that tapers down along the length of the necktie 10 to a narrow end 18. When the necktie 10 is being worn, the wide end 16 is situated over the narrow end 18 to cover and conceal the narrow end 18.

The narrow end 18 of the necktie 10 of the present invention is attached to the wide end 16 by a first attachment means 20. In a first embodiment, the first attachment means 20 comprises a button 22 situated on the front surface 24 of the narrow end 18 and a series of corresponding button holes 26 disposed in the rear surface 28 of the wide end 16 such that the holes are not visible on the front surface 30 of the wide end 16. The button holes 26 are spaced so as to allow for the adjustment of the tie 10 and the attachment of the button 22 on the narrow end 18 at various locations along the length of the wide end 16. It should be appreciated that while the button 22 and button holes 26 are the preferred means of attachment, other attachment means are contemplated, such as snaps, hooks, clips, clasps, hook and loop fasteners and zippers.

In this embodiment, the entire necktie 10 is attached to the shirt 12 by a second attachment means 32 comprising a plurality of button holes 34 disposed in the rear surface 36 of the narrow end 18 such that said button holes 34 are not visible on the front surface 24. The spacing of these button holes 34 in this embodiment is designed to be identical to the spacing of the buttons 14 on the shirt 12 such that the necktie 10 may be buttoned directly to the shirt 12. It should be appreciated that other means for attaching the necktie 10 to the buttons 14 of the shirt 12 are contemplated, such as clasps or loops designed to receive and retain the buttons 14.

In a second, preferred embodiment, the first attachment means 20 comprises at least one button 22 situated on the rear surface 28 of the wide end 16 and a series of button holes 26 disposed in the narrow end 18, said button holes 26 being situated at regular intervals along the length of the narrow end 18. The button holes 26 of this embodiment are spaced so as to allow for the adjustment of the necktie 10 and the attachment of at least one button 22 from the wide end 16 at various locations along the length of the narrow end 18, so as to accommodate necks of different circumferences. Ideally, the narrow end 18 should be attached to the wide end 16 so as to create a smooth, uninterrupted appearance to the tie 10. The entire necktie 10 is attached to the shirt 12 by the same series of button holes 26. In this embodiment, at least one, but preferably two or more of the buttons 14 on the shirt 12 are inserted into corresponding button holes 26 on the narrow end 18 of the necktie 10 to secure the two articles of clothing to each other. Here too, it is desired that the necktie 10 as attached to the shirt 12 present a smooth, natural appearance. Toward that end, a spacing of approximately ¼inch between button holes 26 (each of which ideally is approximately ¾inch in length) has been found to present sufficient spacing to allow for variable adjustment of the necktie 10. Similarly a spacing of between 8 and 10 inches between buttons 22 is also ideal to allow for variable adjustment of the narrow end 18 to the wide end 16. Of course, other means of attachment are also contemplated in this embodiment, including snaps, hook and loop fasteners, clasps, etc.

Having thus described the invention with particular reference to the preferred forms thereof, it will be obvious that various changes and modifications can be made therein without departing from the spirit and scope of the present invention as defined by the appended claims.

What is claimed is:

1. A necktie removably attachable to a button-down shirt of the type having a row of buttons disposed down the front thereof, said necktie comprising a single elongated article of clothing having a wide end having front and rear surfaces and a narrow end having front and rear surfaces, wherein first attachment means are provided on said rear surface of said wide end and said front surface of said narrow end to fixedly attach said wide end to said narrow end such that said first attachment means is not visible on said front surface of said wide end, and wherein second attachment means are provided on said rear surface of said narrow end to fixedly attach said rear surface of said narrow end to said row of buttons such that said first attachment means and said second attachment means are completely invisible to outward appearance to thereby create an aesthetically pleasing and completely natural appearance to said necktie.

2. The necktie of claim 1, wherein said first attachment means comprises at least one first attachment button disposed on said front surface of said narrow end and a plurality of corresponding first attachment button holes disposed on said rear surface of said wide end.

3. The necktie of claim 1, wherein said second attachment means comprises a plurality of second attachment button holes corresponding to said buttons on said shirt disposed on said rear surface of said narrow end.

4. The necktie of claim 1, wherein said first attachment means and said second attachment means comprise at least one button disposed on said rear surface of said wide end and a plurality of button holes disposed within said narrow end, wherein said at least one button on said wide end may be inserted within and engaged by at least one button hole so as to secure said wide end to said narrow end, and further wherein at least one button on said shirt may be inserted within and engaged by at least one button hole on said narrow end so as to secure said necktie to said shirt.

5. The necktie of claim 4, wherein two buttons are disposed on said rear surface of said wide end, said buttons being separated by a distance of 7 inches.

6. The necktie of claim 4, said button holes are approximately ¾ inch in length and are separated from each other by approximately ¼ inch.

7. A necktie removably attachable to a button-down shirt of the type having a row of buttons disposed down the front thereof, said necktie comprising a single elongated article of clothing having a wide end having front and rear surfaces and a narrow end, wherein at least one button is provided on said rear surface of said wide end and a plurality of button holes is provided on said narrow end such that said wide end is fixedly attachable to said narrow end by engaging said at least one button within at least one of said plurality of button holes such that said at least one button is not visible when said necktie is being worn, and further wherein said narrow end is fixedly attachable to said shirt by engaging at least one of said row of buttons on said shirt within at least one of said plurality of button holes, such that said attachment of said buttons to said button holes is completely invisible to outward appearance to thereby create an aesthetically pleasing and completely natural appearance to said necktie.

* * * * *